US006668744B2

(12) United States Patent
Coates et al.

(10) Patent No.: US 6,668,744 B2
(45) Date of Patent: Dec. 30, 2003

(54) VESSEL FLOATATION AID

(76) Inventors: John Coates, 80 Glenifern Ave., Hamilton, Ontario (CA), LP8 2T8; Paul Coates, 60 James Street, Burford, Ontario (CA), N0E 1A0

( * ) Notice: Subject to any disclaimer, the term of this patent is extended or adjusted under 35 U.S.C. 154(b) by 0 days.

(21) Appl. No.: 10/173,440

(22) Filed: Jun. 18, 2002

(65) Prior Publication Data

US 2003/0010271 A1 Jan. 16, 2003

Related U.S. Application Data

(60) Provisional application No. 60/304,436, filed on Jul. 12, 2001.

(51) Int. Cl.[7] ..... B63B 43/14
(52) U.S. Cl. ..... 114/123
(58) Field of Search ..... 114/345, 357, 114/68, 123, 61.1

(56) References Cited

U.S. PATENT DOCUMENTS

| | | | | | |
|---|---|---|---|---|---|
| 1,369,670 | A | | 2/1921 | Kauffman | |
| 1,736,157 | A | * | 11/1929 | Harter | 114/123 |
| 2,544,599 | A | * | 3/1951 | Keelen | 114/364 |
| 3,537,417 | A | | 11/1970 | Backner | 114/123 |
| 3,792,676 | A | | 2/1974 | Craft | 114/123 |
| 4,512,277 | A | | 4/1985 | Williams | 114/364 |
| 4,516,943 | A | * | 5/1985 | Spieldiener et al. | 441/35 |
| 4,807,551 | A | | 2/1989 | Ace | 114/123 |
| 4,864,960 | A | | 9/1989 | Sansoucy | 114/345 |
| 4,875,426 | A | | 10/1989 | Soga et al. | 114/123 |
| 4,977,844 | A | | 12/1990 | Barr | 114/123 |
| 5,411,425 | A | * | 5/1995 | Rinker | 441/130 |
| 5,515,802 | A | * | 5/1996 | Bree | 114/123 |
| 5,832,857 | A | * | 11/1998 | McPherson | 114/219 |

* cited by examiner

*Primary Examiner*—Stephen Avila

(57) ABSTRACT

The present invention is a vessel floatation aid for vessels of the type including a water line and laterally spaced gunwales. The floatation aid includes an inflatable bladder including an outer membrane attached to a backer strap and the space there between defining said inflatable portion, such that said backer strap and outer membrane together oriented along said longitudinal direction for temporarily providing increased buoyancy; and including upper tabs and lower tabs connected to a backer strap, said tabs adapted for receiving cords for temporarily lashing said floatation aid to a vessel for releasably and temporarily attaching said buoyancy means below and adjacent a gunwale of a vessel, and proximate a waterline.

11 Claims, 4 Drawing Sheets

VESSEL FLOATATION AID

This applciation claims the benefit of provisional application No. 60/304,436 filed Jul. 12, 2001.

FIELD OF THE INVENTION

This invention relates generally to devices used for stabilizing water craft and more specifically to floatation aids for water craft.

BACKGROUND OF THE INVENTION

Those familiar with small watercraft and in particular canoes, will appreciate that these type of watercraft tend to be inherently unstable. In addition, many small watercraft have little free board to begin and when loaded down with persons and gear the amount of free board available in small water crafts becomes even less, increasing the likelihood of the craft to take on water, particularly in rough seas. Therefore, there is a need for some type of stabilizing means and or buoyancy means to be provided for small watercraft and canoes.

Many devices have been patented and/or manufactured to act as stabilizing or buoyancy means for water crafts, boats and canoes. Such devices normally include a pair of float elements and a means for connecting same to the boat or the canoe. In some cases, the floats are formed from floatation members that require bracket elements to mount the floats to a boat or canoe. In addition, the method of fastening the floatation members, often makes it difficult to mount and dismount the floatation members to such an extent that most users just leave the floatation members installed.

Floats are normally made of materials requiring the floats to be of a size which is somewhat encumbering. The frame for securing the various floats to the canoes or boats are generally formed from articulated arms or various other adjustable connections for positioning the floats relative to the water line of the canoe or boat. The above devices are disadvantageous in that they are difficult to attach and remove, create too much drag in the water, and their bulkiness makes it more difficult to portage the canoe or boat. Multiple types of articulate and/or adjusting mounting frames are expensive to manufacture and heavy in weight and usually are so mounted on the boat or canoe as to add undue stress to the point of attachment.

THE PRIOR ART

Some examples of the prior art patented in regard to similar inventions is found in U.S. Pat. Nos. 1,369,670, 3,537,417, 4,807,551, 4,977,844, 4,512,277, 4,875,426 and 4,864,960.

Particularly interesting may be U.S. Pat. No. 3,763,813 issued Oct. 9, 1973 to Holtz which shows a unique outrigger concept using an inflatable canoe as well as inflatable outrigger members, each of which is provided with a permanent mounting arrangement for receiving a pair of supporting poles frictionally engaged between the canoe and the outrigger. The problem with this particular arrangement is that it is extremely specific and incapable for use on other types of small boats, other than that shown in the patent.

Further of interest is U.S. Pat. No. 4,864,960 to San Souce, titled Knock Down Semi-Rigid Inflatable Canoe which depicts a canoe which is partially rigid and partially inflatable. The problem with this particular arrangement is that it is extremely specific to a type of canoe and not capable of being applied to other types of small water craft or canoes. Secondly, it is a permanent arrangement and not detachable as is the case with the present invention.

There is a need for a device which is extremely light in weight, does not add undue stress to parts of a water craft, boat, or canoe and provides the maximum buoyancy and stability to the water craft when under way and fully loaded.

SUMMARY OF THE INVENTION

The present invention a vessel floatation aid for vessels of the type including a water line and laterally spaced gunwales, said floatation aid comprises:

(a) a means for temporarily providing increased buoyancy;

(b) means for releasably and temporarily attaching said buoyancy means below and adjacent a gunwale of a vessel, and just above a waterline.

Preferably wherein said buoyancy means includes an inflatable bladder.

Preferably wherein said inflatable bladder being tubular in shape oriented along a longitudinal direction.

Preferably wherein said bladder including an outer membrane attached to a backer strap and the space there between defining said inflatable portion, such that said backer strap and outer membrane together oriented along said longitudinal direction.

Preferably wherein said attachment means including means for securing cords to said buoyancy means and for temporarily lashing said buoyancy means to a vessel.

Preferably wherein said attachment means including means for securing cords to said backer strap and for temporarily lashing said buoyancy means to a vessel.

Preferably wherein said securing means including upper tabs and lower tabs connected to said backer strap, said tabs adapted for receiving cords for temporarily lashing said floatation aid to a vessel.

Preferably wherein said tabs further including eyelets for receiving said cords there through.

Preferably wherein said securing means including attachment points defined proximate the front and rear of said backer strap for receiving cords for lashing said buoyancy means to a vessel.

Preferably wherein said cords attaching to said upper tabs are secured to the gunwale or upper side of the vessel, whereas the cords secured to said lower tabs being lashed around the outside bottom of a hull of a vessel.

Preferably wherein said cords attaching to said lower tabs are secured at one end to lower tabs of a port side floatation aid, around the bottom of a hull where at the other end they attach to lower tabs of a starboard side floatation aid thereby securing both starboard and port floatation aids.

In an alternate embodiment the present invention includes in combination a vessel of the type including a water line and laterally spaced gunwales and at least one floatation aid lashed to a starboard side and at least one floatation lashed to a port side of a vessel.

In an alternate embodiment the present invention includes a method for improving the buoyancy of a vessel of the type including a water line and laterally spaced gunwales, said method including the steps:

a) temporarily lashing at least two floatation aids, one on a port side and the other on a starboard side of a vessel, said floatation aids located below and adjacent a gunwale and just above a waterline;

b) inflating said bladder of said floatation aids; and c) removing said floatation aids when no longer needed.

BRIEF DESCRIPTION OF THE DRAWINGS

The invention will now be described by way of example only, with references to the following drawings in which.

DETAILED DESCRIPTION OF THE PREFERRED EMBODIMENT

Figure 1:
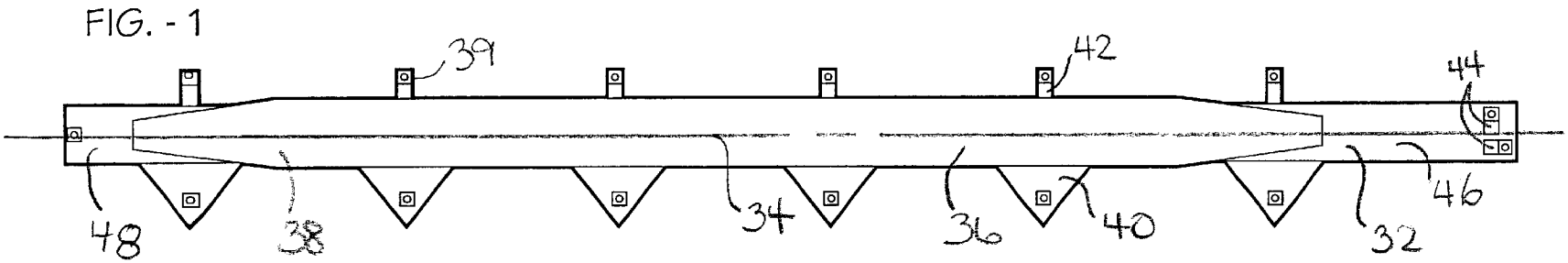
FIG. 1 is a schematic top elevational side view of the present invention, a floatation aid.
Figure 2:
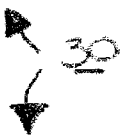
FIG. 2 is a perspective bottom side elevational view of the present invention, a floatation aid.
Figure 2:
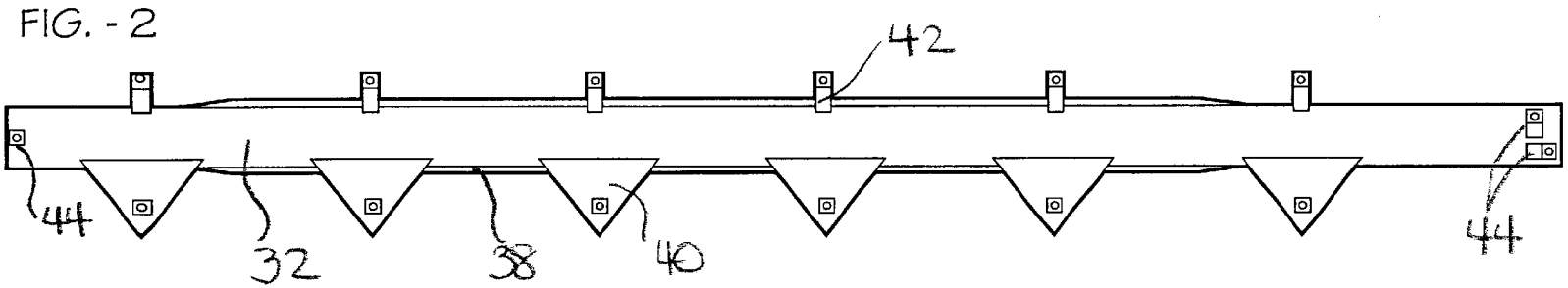
Figure 3:
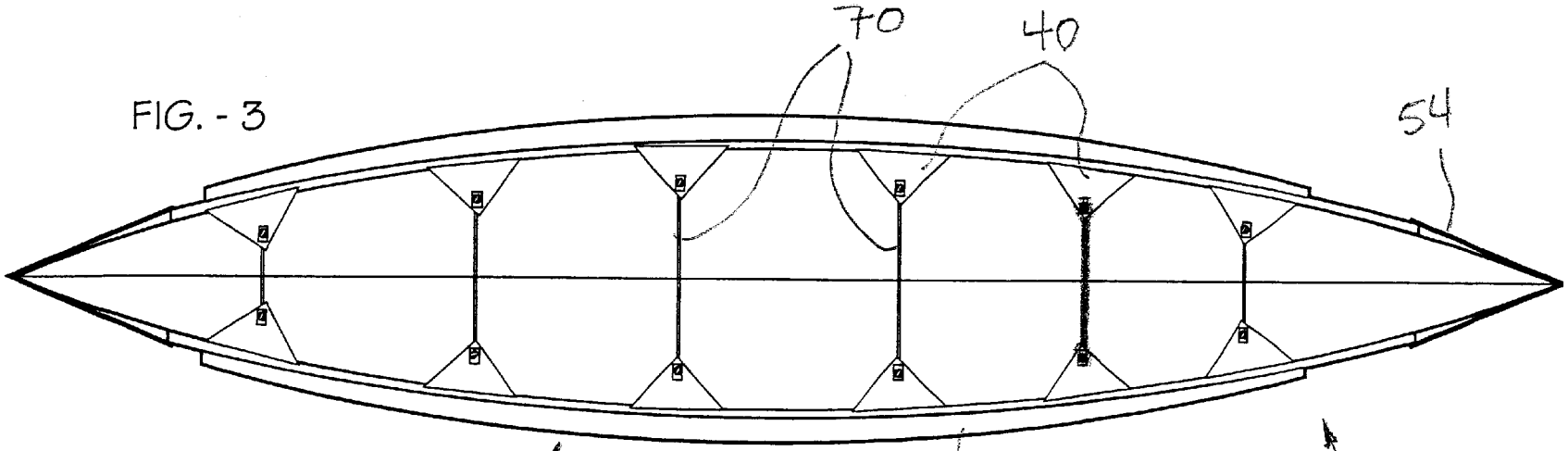
FIG. 3 is a bottom plan view of the floatation aid deployed onto a canoe.
Figure 4:
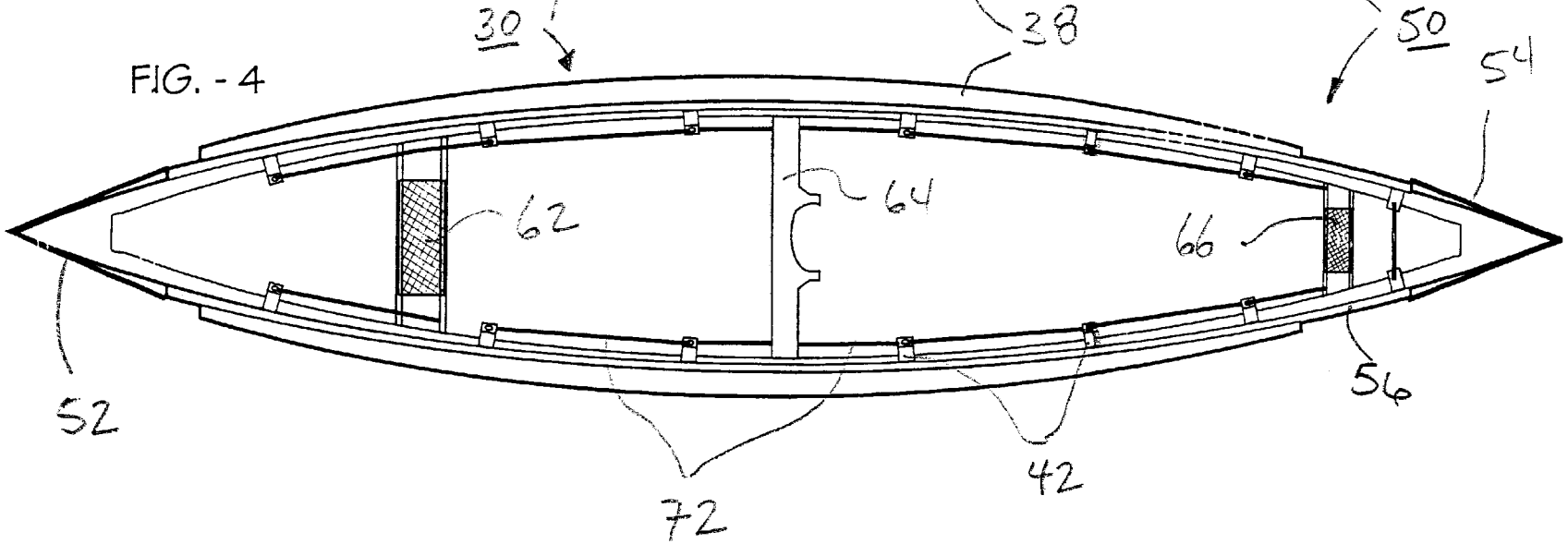
FIG. 4 is a top plan view of the floatation aid deployed onto a canoe.

The present invention a vessel floatation aid shown generally as 30 in FIGS. 1 and 2, includes the following major components, namely backer strap 32, oriented along a longitudinal direction 34, having attached thereon an outer membrane 36 together forming an inflatable bladder 38. Additionally, lower tabs 40 and upper tabs 42 are securely attached to backer strap 32 as shown in the diagrams and as well backer strap 32 preferably will also have a number of attachment points 44 located both at the front 46 and rear 48 of backer strap 42.

Upper and lower tabs have eyelets 39 defined therein which normally are made of brass grommets.

Installation of Floatation Aid

Figures 5, 6:
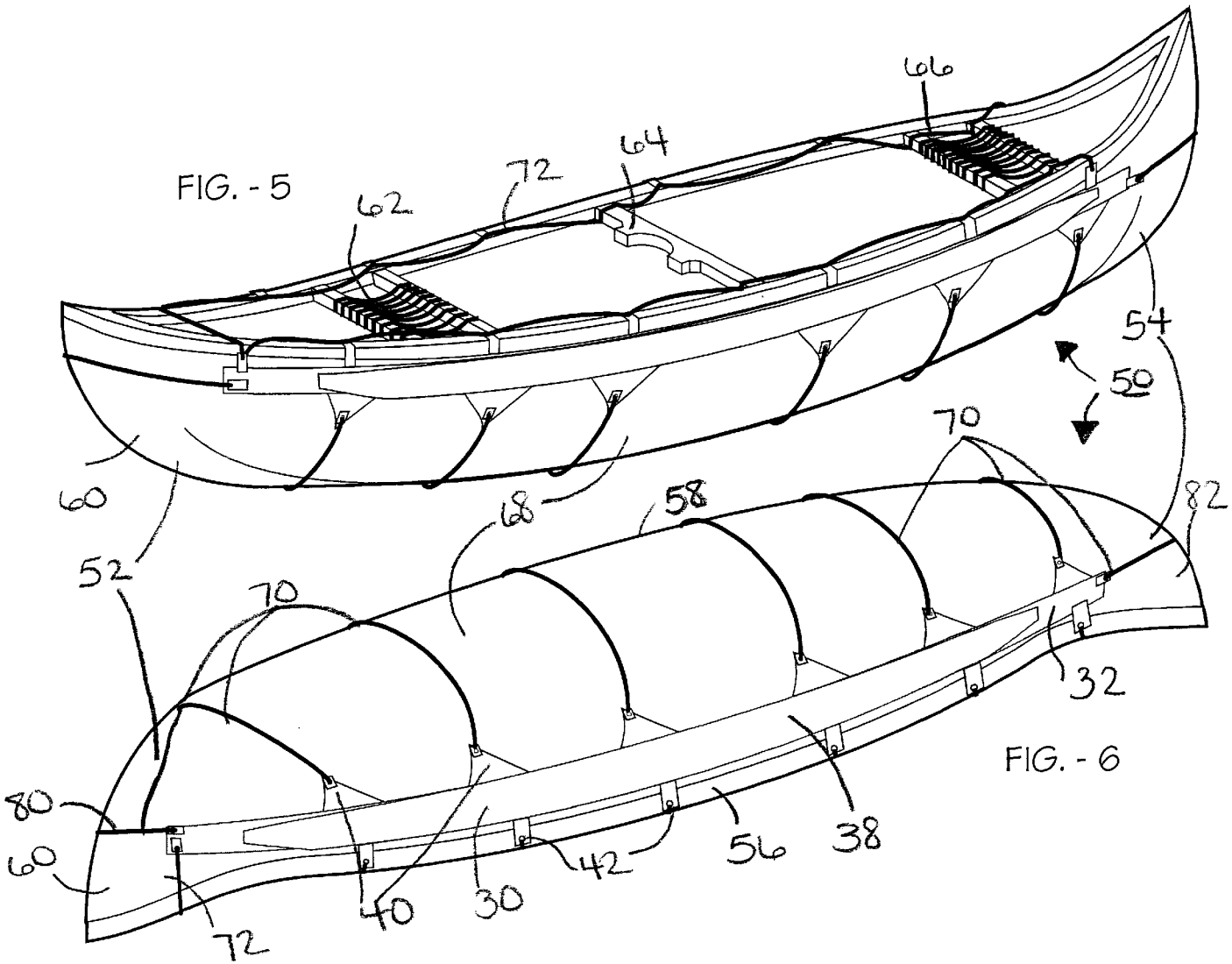
FIG. 5 is a top perspective view of the floatation aid lashed and deployed onto a canoe.
FIG. 6 is a bottom perspective view lashed and deployed onto a canoe.

Referring now to FIGS. 5 and 6, floatation aid 30 is shown deployed onto a canoe 50 in schematic fashion. Canoe 50 includes bow 52, stem 54, gun wales 56, keel 58, stem 60, front seat 62, centre thwart 64 and rear seat 66 as is typical for most canoes.

It would be apparent to those skilled in the art that floatation aid 30 can be installed and deployed onto any number of vessels, however by way of example only, we have chosen to show it deployed onto a canoe which is the preferred type of vessel since canoes tend to be less stable than larger boats and vessels having deeper keels or having larger displacements.

Floatation aid 30 is deployed onto canoe 50 using hull cords 70 which are lashed around the bottom of hull 68 of canoe 50. Note that hull cords 70 are attached at one end to lower tabs 40 of a port side flotation aid 30 and are attached at the other end to lower tabs 40 of a starboard side floatation aid 30. Similarly bow cords 80 and stem cords 82 are lashed around the stem 60 and stem 54 of canoe 50 also extending from a port side flotation aid to starboard side floatation aid.

Upper cords 72 are attached to upper tabs 42 of floatation aid 30 and can be lashed to any appropriate spot on the upper side of canoe 50. Schematically depicted in FIG. 5, upper cord 72 is lashed to front seat 62, centre thwart 64 and rear seat 66, in such a manner to ensure that floatation aid 30 is securely attached to canoe 50. It will be understood by those skilled in the art that upper cord 72, may be one or more cords which are threaded through the eyelets in upper tabs 42 and lashed onto appropriate parts of the upper side of canoe 50 in order to maintain floatation aid 30 securely in its place on canoe 50.

It will also be appreciated by those skilled in the art that hull cords 70 are dimensioned to be as thin as possible in order to minimize drag across the bottom of hull 68 when canoe 50 is travelling through water. Therefore the thickness of hull cord 70 is selected to be as thin as possible, yet maintaining sufficient strength to maintain floatation aid 30 in place and providing enough tensile strength in order that hull cord 70 can withstand the loads applied.

In Use

Figure 7:
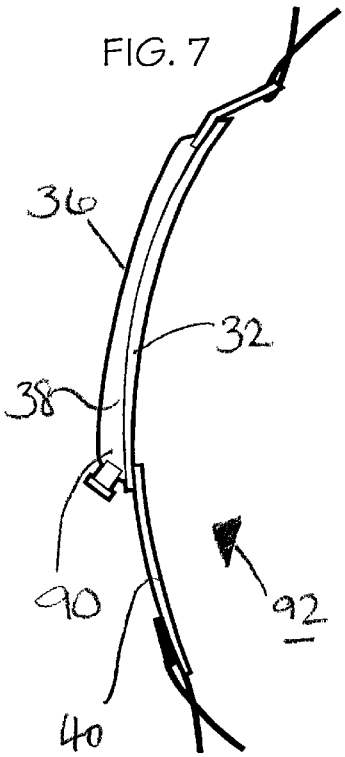
FIG. 7 is a schematic cross-section view of the floatation aid showing a deflated bladder.
Figure 8:
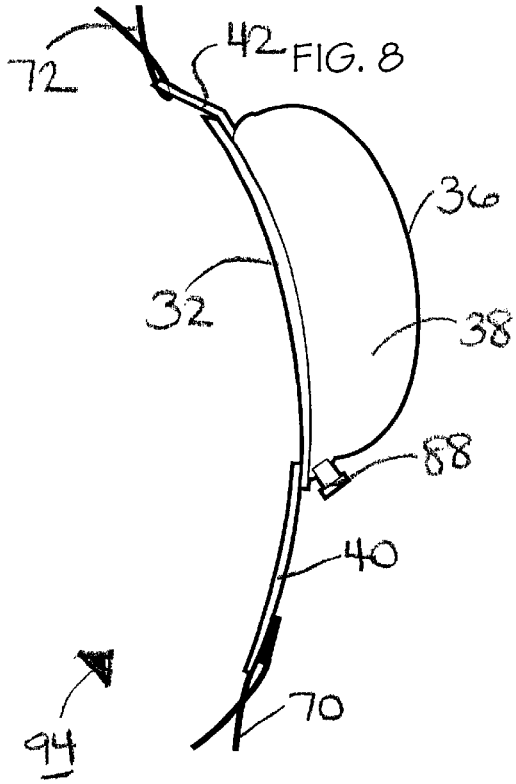
FIG. 8 is a schematic cross-sectional view of the floatation aid showing an inflated bladder.
Figure 9:
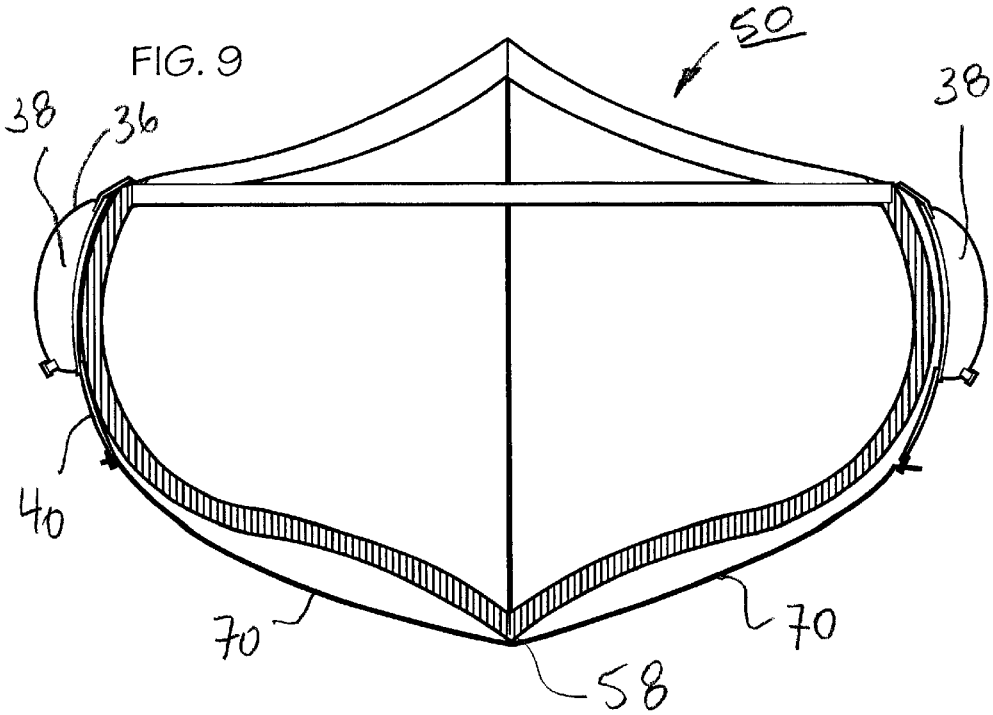
FIG. 9 is a cross-sectional view of the floatation aid deployed on each side of a canoe.

Using floatation aid 30 for example with a canoe 50 as depicted in FIG. 5, floatation aids 30 are lashed onto canoe 50 as shown in FIGS. 3–6 and as well 9. With floatation aid 30 lashed onto canoe 50, bladder 38 is inflated manually or with a mechanized pump from deflated position 92 as shown in FIG. 7 to an inflated position 94 shown in FIG. 8. Bladder 38 preferably includes an air valve 88 of the type known in the art which can be used to inflate and deflate bladder 38.

With bladder 38 in the inflated position 94, the bottom sides 90 of bladder 38 preferably are located proximate the water line of the vessel to which it is attached. Therefore, upon loading of the vessel with gear and persons, the bladders 38 aid in the floatation and buoyancy of canoe 50. The additional floatation provided by bladders 38 will increase the loaded free board of the vessel or canoe 50 and in addition will increase the stability by minimizing the heeling action of the canoe.

It will also be apparent to a person skilled in the art that floatation aid 30 can easily and quickly be attached or removed from canoe 50 as it is required. For example, should trekkers come upon inclement weather and high waves and/or should the vessel be loaded down with additional ballast, for example with animal carcasses during hunting trips, the operator could lash floatation aids 30 onto his canoe 50 and temporarily increase the load carrying capability and the stability of the vessel.

In regard to the construction of the floatation aid 30, outer membrane 36 is preferably constructed of a Kevlar® reinforced plastic or vinyl material and the outer membrane preferably is RF (radio frequency) welded to the backer strap which is also made of the Kevlar® reinforced vinyl and/or plastic. There is no reason why other techniques for constructing the bladder 38 could not be used, however at the present time RF welding of Kevlar® reinforced vinyl appears to be the best option. It is critical that outer membrane 36 together with backer strap 32 create a bladder 38 which is air tight in order to hold air in bladder 38 over extended periods of time. The materials are selected to achieve adequate abrasion and puncture resistance in keeping with the intended application.

It should be apparent to persons skilled in the arts that various modifications and adaptation of this structure described above are possible without departure from the spirit of the invention the scope of which defined in the appended claim.

I claim:

1. A vessel floatation aid for vessels of the type including a water line and laterally spaced gunwales, said floatation aid comprising:

(a) a means for temporarily providing increased buoyancy, said buoyancy means including a flexible substantially half pipe tubular shaped inflatable bladder oriented alone a longitudinal direction and extending substantially the entire length of a gunwale of a vessel;

(b) said bladder formed out of at least two substantially longitudinally continuous flexible elements; including a half pipe shaped outer membrane attached to a planar backer strap, wherein the space between said outer membrane and said backer strap defining an inflatable portion;

(c) means for releasably and temporarily attaching said buoyancy means below and adjacent substantially the entire length of a gunwale of a vessel, and just above the resting vessel waterline, wherein one side of said backer strap oriented adjacent to and conforming to the outer curvature of said vessel; and (d) means for inflating and deflating said bladder.

2. The floatation aid claimed in claim 1 wherein said buoyancy means includes a rear portion and front portion comprised of said backer strap without said outer membrane, such that said front and rear portions conform easily to said bow and stern of said vessel.

3. The floatation aid claimed in claim 1 wherein said attachment means including means for securing cords to said buoyancy means and for temporarily lashing said buoyancy means to a vessel.

4. The floatation aid claimed in claim 3 wherein said securing means including upper tabs and lower tabs connected to said backer strap, said tabs located at substantially equal intervals along a longitudinal length of said buoyancy means and said tabs adapted for receiving cords for temporarily lashing said floatation aid to a vessel.

5. The floatation aid claimed in claim 4 wherein said tabs further including eyelets for receiving said cords there through.

6. The floatation aid claimed in claim 2 wherein said securing means including attachment points defined proximate said front portion and said rear portion of said backer strap for receiving cords for lashing said buoyancy means to a bow and stern of a vessel.

7. The floatation aid claimed in claim 4, wherein said cords attaching to said upper tabs are secured to the gunwale or upper side of the vessel, whereas the cords secured to said lower tabs being lashed around the outside bottom of a hull of a vessel.

8. The floatation aid claimed in claim 7, wherein said cords attaching to said lower tabs are secured at one end to lower tabs of a port side floatation aid, around the bottom of a hull where at the other end they attach to lower tabs of a starboard side floatation aid thereby securing both starboard and port floatation aids.

9. The floatation aid claimed in claim 1 wherein said inflation and deflation means includes an air valve.

10. In combination a vessel of the type including a water line and laterally spaced gunwales and at least one floatation aid as claimed in claims 5, or 7, lashed to a starboard side and at least one floatation aid lashed to a port side of a vessel.

11. A method for improving the buoyancy of a vessel of the type including a water line and laterally spaced gunwales, said method including the steps:

a) temporarily lashing at least two floatation aids as defined in claims 2, 3, or 7 one on a port side and the other on a starboard side of a vessel, said floatation aids located below and adjacent a gunwale and just above a waterline;

b) inflating said bladder of said floatation aids; and c) removing said floatation aids when no longer needed.

* * * * *